US010612735B2

(12) United States Patent
Bergman et al.

(10) Patent No.: US 10,612,735 B2
(45) Date of Patent: Apr. 7, 2020

(54) LIGHTING DEVICE ON GRID SHEET CARRIER

(71) Applicant: SIGNIFY HOLDING B.V., Eindhoven (NL)

(72) Inventors: Anthonie Hendrik Bergman, Eindhoven (NL); Tim Dekker, Eindhoven (NL); Jochen Renaat Van Gheluwe, Eindhoven (NL); Siebe Tjerk De Zwart, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 60 days.

(21) Appl. No.: 15/764,491

(22) PCT Filed: Oct. 3, 2016

(86) PCT No.: PCT/EP2016/073544
§ 371 (c)(1),
(2) Date: Mar. 29, 2018

(87) PCT Pub. No.: WO2017/060187
PCT Pub. Date: Apr. 13, 2017

(65) Prior Publication Data

US 2019/0056078 A1 Feb. 21, 2019

(30) Foreign Application Priority Data

Oct. 9, 2015 (EP) ..... 15189086

(51) Int. Cl.
*F21S 6/00* (2006.01)
*F21V 23/00* (2015.01)
(Continued)

(52) U.S. Cl.
CPC ..... *F21S 6/00* (2013.01); *F21V 23/001* (2013.01); *F21S 10/023* (2013.01);
(Continued)

(58) Field of Classification Search
CPC ..... F21V 11/06; F21Y 2105/10; F21Y 2105/12–18; F21S 6/00
See application file for complete search history.

(56) References Cited

U.S. PATENT DOCUMENTS 7,726,839 B2 * 6/2010 Chien ..... H04N 5/2354 362/249.03
7,862,206 B2 * 1/2011 Chen ..... G09F 13/22 362/249.03
(Continued)

FOREIGN PATENT DOCUMENTS

DE 19818227 A1 10/1999
EP 0645748 A1 3/1995
(Continued)

OTHER PUBLICATIONS http://www.world-semi.com "WS2812—Intelligent Control LED Integrated Light Source", undated, 5 pages.

*Primary Examiner* — Karabi Guharay
*Assistant Examiner* — Michael Chiang
(74) *Attorney, Agent, or Firm* — Akarsh P. Belagodu

(57) ABSTRACT

A lighting device comprising a grid sheet carrier 3 mounted via its border 4 on a base part and having an open surface area 5 of a plurality of openings 7 and having carrier material 9 surrounding said openings. The carrier material 9 being arranged in a two-dimensional, first pattern 11. The lighting device further comprises a plurality of LEDs 13 mounted on one main face 15 of the carrier material 9 and arranged in a two-dimensional, second pattern 17. The second pattern 17 is coinciding with the first pattern 11 when superimposed and the second pattern 17 is at least a sub-pattern of the first pattern 11. Furthermore, R is a ratio between the plurality of LEDs 13 and the plurality of openings 7, wherein R>=3.

14 Claims, 6 Drawing Sheets

(51) Int. Cl.

| | |
|---|---|
| *F21Y 105/10* | (2016.01) |
| *F21Y 115/10* | (2016.01) |
| *F21Y 113/17* | (2016.01) |
| *F21S 10/02* | (2006.01) |
| *F21Y 113/13* | (2016.01) |

(52) U.S. Cl.
CPC ..... *F21Y 2105/10* (2016.08); *F21Y 2113/13* (2016.08); *F21Y 2113/17* (2016.08); *F21Y 2115/10* (2016.08)

(56) References Cited

U.S. PATENT DOCUMENTS

| | | | | |
|---|---|---|---|---|
| 10,228,100 | B2 * | 3/2019 | Magielse | F21S 4/28 |
| 2005/0258446 | A1 * | 11/2005 | Raos | G09F 9/33 257/99 |
| 2008/0062691 | A1 * | 3/2008 | Villard | F21V 14/02 362/249.16 |
| 2008/0244944 | A1 * | 10/2008 | Nall | G09F 13/04 40/544 |
| 2012/0033426 | A1 * | 2/2012 | Wendt | E04B 9/006 362/249.03 |
| 2013/0223058 | A1 | 8/2013 | Briggs | |
| 2015/0181811 | A1 * | 7/2015 | Krijn | A01G 7/045 47/58.1 LS |
| 2015/0300597 | A1 * | 10/2015 | Baaijens | F21S 8/026 362/148 |
| 2017/0064820 | A1 * | 3/2017 | Rock | H05K 3/303 |
| 2017/0074497 | A1 * | 3/2017 | Jurik | F21V 21/15 |
| 2017/0205045 | A1 | 7/2017 | Baaijens et al. | |

FOREIGN PATENT DOCUMENTS

| | | | |
|---|---|---|---|
| EP | 2419674 | B1 | 8/2015 |
| WO | WO2013153491 | A1 | 10/2013 |
| WO | WO2014187760 | A1 | 11/2014 |

* cited by examiner

LIGHTING DEVICE ON GRID SHEET CARRIER

CROSS-REFERENCE TO PRIOR APPLICATIONS

This application is the U.S. National Phase application under 35 U.S.C. § 371 of International Application No. PCT/EP2016/073544, filed on Oct. 3, 2016, which claims the benefit of European Patent Application No. 15189086.0, filed on Oct. 9, 2015. These applications are hereby incorporated by reference herein.

TECHNICAL FIELD

The invention relates to a lighting device comprising LEDs mounted on a grid sheet carrier.

TECHNICAL BACKGROUND

Ledification of many light sources and systems is nearly done. Almost all conventional products are replaced by LED versions. The first generation LED based lighting was based on so called high power LEDs. This is in comparison to LEDs used for signaling, for example on/off indicators. A high-power LED is a LED with over 1 watt energy consumption. More recently, the use of low- or mid-power LEDs seems even more attractive as, although these light sources produce less light, the lumen per dollar ratio is better than for high-power LEDs. For general lighting purposes a certain amount of lumen is needed and thus quite a few low- or mid-power LEDs. This involves a relatively large mounting surface as well and grid shaped lighting devices are seen suitable to fulfill this need, for example a grid shaped lighting device as is known from EP0645748. The known grid shaped lighting device is generally used as a cheap solution for illumination of large areas. In the known lighting device the grid is formed as a type of chicken wire construction of an electrical current conductive lead wire and a neutral wire. The lead wire and the neutral wire are attached to each other only at nodes and together form the perimeter of more or less square shaped openings, i.e. one half side of an opening is formed by the lead wire, while the opposite half side of the opening is formed by the neutral wire. In general the LEDs can only conveniently be, and are, only mounted at the nodes, thus attaining a mutual attachment of the lead wire to the neutral wire at the nodes via the LEDs. This, however, involves the risk of undesired spottiness and/or inhomogeneous illumination. To counteract said spottiness and/or inhomogeneous illumination in the known lighting device, a diffuser is mounted in front of the grid. This, however, involves the disadvantages that the overall efficiency of the known grid shaped lighting device is relatively low and its obtrusive appearance/presence in the off-state when it has little or no aesthetical value, basically a white box on the wall. Furthermore, in the known lighting device the lead wire and the neutral wire each are formed as one continuous wire to which the LEDs are connected in parallel and all the LEDs can only be switched on/off or dimmed simultaneously by a single power control. This, however, involves the disadvantage that the suitable use of the known lighting device is limited to only a relatively small number of applications.

SUMMARY OF THE INVENTION

It is an object of the invention to provide a lighting device in which at least one disadvantage of the known lighting device is counteracted. The invention thereto provides a lighting device of the type as described in the opening paragraph which comprises:

a grid sheet carrier bordered by a border and comprising an open surface area of a plurality of openings and comprising carrier material surrounding said openings, said carrier material being arranged in a two-dimensional, first pattern, and is mounted via its border on a base part, a plurality of LEDs mounted only on one main face of the carrier material and arranged in a two-dimensional, second pattern, wherein the second pattern is coinciding with the first pattern when superimposed, wherein the second pattern is at least a sub-pattern of the first pattern, and wherein R is a ratio between the plurality of LEDs and the plurality of openings, with R being at least three.

The (relatively) high density of LEDs with respect to the plurality of openings, i.e. R is at least three and preferably at least five, or even more preferably at least eight, for example up to 40, 100, or 200, and the fact that they are mounted only on one main face of the grid sheet carrier, the LEDs can issue light only in essentially a first direction during operation, i.e. in the direction of a reflective surface. The LEDs are arranged to aim light toward said reflective surface during operation such that a majority of said light is reflected back through said openings in the grid sheet carrier. Hence, in an installed orientation, said main face of the lighting device should be turned away from users and towards a reflective body, then the grid sheet carrier hides the LEDs from direct view by users and light source light from the LEDs is reflected as reflected light source light by the reflector body back in a second direction, essentially opposite to said first direction, through the openings. Said reflected light source light is observed by users as a relatively homogeneous illumination through the openings of the grid sheet carrier. Hence, the spottiness is reduced by the feature that essentially only reflected light passing through the openings in the grid sheet carrier is observed by users and that the LEDs do not point towards users but point towards the reflective body, which can, for example, be a wall, ceiling, sculpture, curtain or an associated, dedicated reflector. The reflected light will illuminate the surrounding in a pleasant glowing way. The typical distance from grid to the reflective body, referred to as Dgr, preferably is about in the range of an average shortest distance d between two opposite LEDs around the opening to approach the optimum of the desired light effect. Typically for the invention is that the light issued by the LEDs during operation, essentially needs not to be collimated or condensed, hence the LEDs can be free of additional collimating/beam and/or narrowing optics, for example LEDs having a Lambertian emission profile or beams with a relatively large apex angle measured at FWHM, for example at least 45°, for example an apex angle of at least 60° measured at FWHM, are well-suited. This, in particular, enables the use of COB (Chip On Board) LEDs. This COB package actually can be a lot of small LEDs in a single package. This means high driving voltage and low current. It also means a relative large surface and thus high etendue compared to conventional high-power LEDs. So, in particular these COB LEDs are primarily used for non-beam applications. Using reflective bodies, like a wall, might sound not very efficient as then reflection is probably limited to 80%, but, as the luminaire does not contain any blocking layers at all, in contrast to the prior art grid shaped lighting devices, the overall efficiency can be rather large. And the low- and mid-power LEDs have a relatively high efficacy anyway. Due to the fact that the inventive lighting device uses both indirect illumination and has a large mounting surface, also referred to as a main face, a significant part may be blocked by the luminaire. To minimize this effect the mounting surface, typically metal like for example aluminum or steel, is created as an open structure, generally referred to as the grid sheet carrier. The grid sheet carrier can for example be a perforated or corrugated metal plate, sheet or any network of (curved) lines (having two opposite main faces). The number of openings of the grid preferably is at least eight, but can easily be hundred, and even mount up to thousand or even more. Since this mounting surface, as a bonus effect, also acts as a heatsink/heat spreader, this also facilitates convective cooling as it allows free airflow. The open structure of the grid sheet carrier can therefore also be made very thin, typically 0.1-3.0 mm; the thickness requirement will mainly be determined by mechanical requirements, depending on the form of execution of the lighting device, for example if a self-supporting structure of the lighting device is wanted. Even a floppy version can be imagined although enough heat spreading capability must be maintained.

The base part on which the grid sheet is mounted and for powering and control of the LEDs can accommodate a (programmable) control unit (controller), connectors to mains supply, a voltage converter, receiver for receiving remote control signals, and an on/off switch. With the grid sheet mounted on said base part, the lighting device is suitable to function as a free standing lighting device on its base or being suspended via its base from a ceiling or a wall. Generally the border of said grid sheet carrier is fully circumferential formed by several side edges. However, the border of said grid sheet may also only be locally provided with a side edge, for example over only 10% to 20%, of only one side of the border, or only provided in a corner formed by two of said sides of the border, and said mounting in a base part then is via said local side edge or via said corner. Alternatively to the grid sheet being mounted via its border on a base part, the grid sheet may comprise at least one support pole mounted on the same main face as the LEDs and extending essentially transverse to the plane of the grid. The support pole in general having a length about equal to the average cross-sectional size of the openings. Via said at least one support pole the grid sheet can be mounted on a reflective body, for example a vertical wall, façade, ceiling or stand-alone reflector.

The inventive lighting device enables very minimalistic designs. Quite often when an elegant design was made using high-power LEDs the technical requirement of a large heatsink, to keep the LEDs at an acceptable temperature, ruined the appearance of the design. In the inventive lighting device, the large surface covered with low- or mid-power LEDs is quite well capable of keeping the LEDs cool, and the grid is ultra-thin as it is basically just a grid of sheet metal. So, this enables the designer to apply minimalism in every way. The transparency of the grid sheet carrier enables to see the structure behind the grid sheet carrier, so in the off state the grid sheet carrier blends in with the environment, while in the on state, the structure behind the grid sheet carrier can be used as a projection canvas. Because the LEDs are packed closely together on a relative small area, creation of a dynamic light content with a very high perceived dynamic resolution is enabled and at the same time provide a very cost effective solution.

The expression "majority" means at least 50%, preferably at least 70%, for example at least 75% of said light. The expressions "two-dimensional first/second pattern" mean that the LEDs and the grid might initially be arranged in a flat, co-planar arrangement, i.e. embedded in 2-dimensional Euclidian space, but optionally in a later stage, for example in following process steps during manufacturing, may be further shaped to assume a non-coplanar shape, i.e. embedded in 3-dimensional Euclidian space. Furthermore, the expression "the second pattern is at least a sub-pattern of the first pattern" means that the second pattern forms a part of or is equal to the whole first pattern, but does not extend beyond the first pattern. The first pattern can extend beyond the second pattern, though.

Basically, the inventive lighting device comprises an open two dimensional structure on which (individually) controllable lights sources are placed, designed to generate a lighting pattern which is partly directed through openings of the two dimensional structure by means of reflection via a reflective surface. As a result, an observer of the lighting device sees the lighting pattern which is partly blocked by the two dimensional structure. The strong contrast between the lighting pattern and the open two dimensional structure provides a kind of 3D effect. Just projecting a similar pattern by means of a beamer gives a totally different impression. Typically, designers want to hide the structure that enables the generation and/or projection and/or distribution of light. Here it is deliberately made (permanently) visible.

In short, the following features can be attributed to the inventive lighting device:

- use of relatively dense arrangement of many LED light sources, in contrast to what is the case for the known lighting device;
- minimalistic in the sense of multiple functional aspects in one part, i.e. holding the LEDs mechanical and providing thermal management;
- minimalistic in the sense of reduction to necessary elements only, i.e. absence of a diffuser, but instead use of reflective light by LEDs pointing to a reflective body when correctly installed;
- transparent, see-through as a result of many large holes;
- ultra-thin, lightweight and cost efficient, because of low material use, absence of optical elements and cheap manufacturing, for example via a punch and die process of single metal sheet.

The lighting device can have each opening associated with at least four LEDs, preferably with at least eight LEDs. By this feature, in combination with the relatively high, LED to opening ratio, the homogeneity and light level of attained illumination is further improved. By further increasing this ratio, i.e. to at least 10, for example 25, the homogeneity and light level of attained illumination is even further improved. Such further improvement can further be realized by a lighting device wherein each opening has a perimeter of bridges and nodes formed by the carrier material, wherein the bridges are mutually connected at nodes, and wherein the LEDs are mounted at both the bridges and the nodes. Nodes are formed by intersection/connection points of at least three bridges, comparable to multiple way junction in traffic like a three-way junction or cross-road. Preferably, for n-sided geometrically shaped openings, each n-sided opening has at least 4*n LEDs evenly distributed around the perimeter of said opening, for example, a rectangle has four sides over which at least 4*4 LEDs are evenly distributed. Yet, if the rectangle has long sides which are significantly longer than its short sides, the number of LEDs on the long side can be more than the number of LEDs on the short side, for example 5:3 or 6:2, as long as the average number of LEDs per side is at least four. Further, and just for comparison reasons, in the known grid shaped lighting device each opening is associated with four LEDs only at its corners (nodes), but shares these four LEDs with four neighboring openings, i.e. the ratio between the number of LEDs and openings is one.

The lighting device can have LEDs that are individually addressable via a data cable provided at bridges and nodes and which data cable is connected to a (separate) controller thus enabling a dynamic illumination effects and/or change in static illumination patterns. Each LED can be controlled individually in color, frequency and brightness. Alternatively, it is possible to have such control/addressability for groups of LEDs, for example for two, three, four, five or even up to twelve groups. Then each group, for example, has its respective string and data entry cable. The controller is able to read or accept content and translate it to appropriate LED control signals. The controller can be a separate controller, remotely arranged from the lighting device, or alternatively can be integrated in the lighting device. The controller is a small microprocessor which is able to read content from a (removable) memory, and converts this into the appropriate control signals to control each led on the grid. Content selection can be done via a button or a simple remote. The controller can also be connected to the cloud, a hub or a smart device to receive data. Content selection is done via a button, a simple remote, the cloud or a connected smart device. Or an If This Then That (ITTT) setup can be arranged for example to enhance enjoying a soccer match a goal might trigger certain sequences. A power supply provides power to both the LEDs and the controller. The lighting device wherein the LEDs are connected in parallel to a power supply and are connected in series to the data cable is a relatively simple configuration for obtaining the individual addressing feature. Then the grid sheet carrier can electronically be seen as a single LED strip with enabled individual addressing.

To fully benefit from the individual addressing feature of the LEDs the lighting device can comprise RGB LEDs, preferably RGBW LEDs, even more preferably RGBWA LEDs, thus enabling static and/or dynamic color patterns of (observed) illumination. However, it may be appreciated that also inventive lighting devices without the individual addressing feature might comprise RGB LEDs, RGBW LEDs, or RGBWA LEDs. RGBWA LEDs stands for Red, Green, Blue, White and Amber LEDs.

The lighting device can have a surface ratio Sr between the open surface area and the surface formed by the carrier material with $1<=Sr<=10$. When Sr is within this ratio, the large surface area covered by the openings compared to the surface area occupied by the grid carrier material enables an effectively and efficiently cooling of the LEDs. As the grid sheet carrier then comprises closed areas, for example the bridges, with only a relatively small width, the transparency of the grid sheet carrier is relatively high. In the off state it is thus enabled to see the structure behind the grid sheet carrier without significant distortion, and then the grid sheet carrier blends in with the environment. While in the on-state relatively low interception by the grid sheet carrier of reflected light occurs due to the relatively small surface, for example because of the small width of the bridges, of the closed areas. Preferably the surface formed by the carrier material, such as the bridges, is equal and constant width over essentially the whole first pattern. In the case of a modular system, each module can be considered a grid cell comprising one opening and its respective perimeter of grid sheet carrier material, with all the grid cells forming the grid sheet carrier, the number of different components is thus reduced, rendering a relatively simple and cheap assembling of the lighting device.

The lighting device of the invention can have openings of an equal size and shape, or have a regular pattern of openings different in size and/or shape. These embodiments are comprised in the expression "the first pattern is a regular grid". In general these types of grid sheet carriers are appreciated because of their attractive geometrical and symmetrical designs and because of their ease of manufacturability. Such a regular grid can be considered to be formed by a tessellation of geometrically shaped openings (also called tiles). The geometrical shapes can be all the same, for example a pattern of single sized squares, or can be a combination of two, three or more geometrical shapes, for example triangles with hexagons, squares with octagons or rhombitrihexagonal tiling (a combination of triangles, squares and hexagons), see more examples at en.wikipedia.org/wiki/tessellation. Alternatively the lighting device of the invention comprises free-form shaped openings, for example openings having curved bridges as their perimeter, and/or openings being arranged in irregular patterns. Generally said openings are mutually different in size and/or shape and/or the entire grid sheet carrier structure may feature further openings, for example relatively large open areas compared to the openings, where the reflective body will not be entirely illuminated. These embodiments are comprised in the expression "the first pattern is an irregular grid" and these embodiments provide attractive, more artistic, free designs like for example a brain shape, organic shapes, logo's, etcetera. Like regular grids, these irregular grids can also be formed as tessellated areas of openings.

The lighting device can further comprise an at least partly diffuse, but preferably a fully diffuse reflector provided at an average distance Drg in the first direction from the grid sheet carrier, Drg being in the range of 0.5 to 2 times an average shortest distance d between two opposite LEDs around an opening, preferably Drg is essentially equal to said average shortest distance d. If the distance Drg is smaller the desired light effect is likely not to evenly illuminate the reflective area enclosed by a carrier material around an opening, i.e. there will be a significant risk of a dark area in the center of said reflective area. If the distance becomes larger the apparent resolution will decrease and light source light will be mixed too much before reaching the reflector. The lighting device of the invention renders a kind of 3D effect due to the grid sheet carrier being in front of the (at least partly diffuse) reflector, the observed reflected light through the openings provides a very good 3D effect when Drg is according to this feature. Note that if the shape of the opening is very asymmetrical, i.e. has a large difference in opposite LED distances, the most prevalent distance between opposite LEDs should preferably be used.

The experience of the 3D effect is further improved if the lighting device fulfills the feature that a ratio CSr between a largest cross section LCS and a smallest cross section SCS of each opening is the range of $1<CSr<=6$. The function of the lighting device with respect to the observed contrast between the first pattern and the (dynamic) light issued through the openings is also experienced better for grid sheet carriers that fulfills this feature then grid sheet carriers that do not meet this feature. Further, it may be appreciated that the features of preferred distance Drg and Cross Section ratio CSr do not only apply for a reflector integrated or comprised in the lighting device, but equally apply for reflective bodies present in the surroundings and that cooperate with the lighting device, like, for example, a wall, a ceiling, a sculpture, a curtain, or an associated but separate reflector.

To position the inventive lighting device at said preferred distance, it can be provided with at least one sensor (separate or integrated) mounted on the same face as the LEDs. Said sensor is then designed to sense in the first direction and optionally gives a signal, for example an audible signal or blinking indicator signal, when the lighting device is positioned at said preferred distance Drg. Alternatively or additionally, such a sensor can, for example, be a light intensity sensor and/or an occupancy sensor, for automatic switching on/off the lighting device.

It may further be appreciated that the ratio R between the plurality of LEDs and openings is related to the size of the opening, i.e. is related to LCS and SCS (and hence to Drg). Typically, the ratio R increases with increasing (average) size of the openings. For example, square openings having a large opening size, for example having an LCS and SCS of about 20 cm, could have about 40 LEDs on each side. Hence, said large opening is associated with 160 LEDs, said 160 LEDs are shared on average between two openings, hence the ratio R between the plurality of LEDs and openings is 80. Despite the large size of the opening a dark area is not observed in the center of said reflective area through the opening due to the large number of associated LEDs with said large opening and the fact that Drg is adjusted accordingly to the size of said opening, i.e. Drg is about 20 cm as well. Furthermore a Lambertian beam or a beam with an apex of about 60° issued from LEDs, e.g. COB LEDs, contribute to a further improvement in homogeneity of observed illuminated area and reflected light.

The lighting device can have the first pattern made in modules, but preferably is made in one integral part to form one integral body, for example via a relatively and easy stamp and die process. This involves a well-known and simple manufacturing process step thus rendering the lighting device to be relatively cheap.

The lighting device can comprise a grid sheet carrier which is self-supporting. Contrary to the known lighting device which is formed from flexible wires and which can only suspend from a (separate) support or needs to be stretched over an unaesthetic (separate) frame. Then the inventive lighting device enables a more versatile range of aesthetic designs, for example a stand-alone grid sheet carrier, than is enabled by the known grid-shaped lighting device.

DESCRIPTION OF THE DRAWINGS

The invention will now be further elucidated by means of preferred embodiments given in the schematic drawings, in which.

DETAILED DESCRIPTION OF PREFERRED EMBODIMENTS

Figure 1:
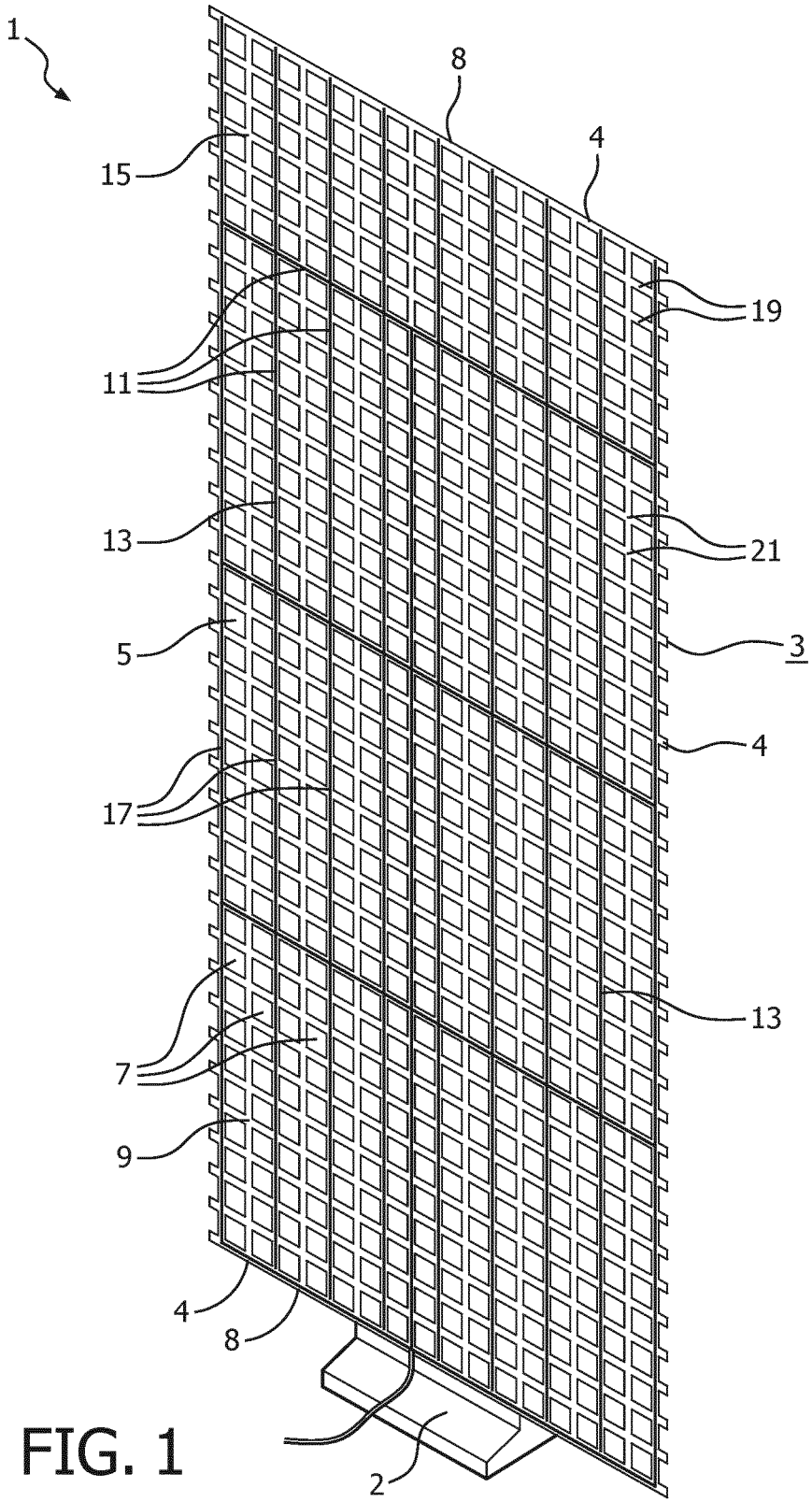
FIG. 1 shows a first embodiment of the lighting device according to the invention.

FIG. 1 shows a prototype of a first embodiment of the lighting device 1 according to the invention illustrating the principle structure of the lighting device. The lighting device comprises a grid sheet carrier 3 having a border 4 having two opposite side edges 8. The grid sheet carrier comprising an open surface area 5 which is the sum of a plurality of openings 7 and comprising carrier material 9 surrounding each of said openings with a respective perimeter 10 of grid sheet carrier material, said carrier material being arranged in a two-dimensional, first pattern 11 which is similar to the shape of a trellis. The grid sheet carrier is mounted via a part of its side edges 8 of border 4 on a base part 2. A plurality of LEDs 13 mounted on both bridges 19 and nodes 21 on only a first main face 15 of the carrier material and arranged in a two-dimensional, second pattern 17 of parallel lines. The LEDs arranged to aim light toward a reflective surface during operation such that a majority of said light is reflected back through said openings in the grid sheet carrier. The second pattern of parallel lines is coinciding with the trellis first pattern when superimposed and is a sub-pattern of said first pattern. Eight LEDs are arranged at only one side of the perimeter of each opening, hence the number of associated LEDs per opening is eight, and a ratio R between the plurality of LEDs and the plurality of openings is four, i.e. R>=3, as said eight associated LEDs per opening are shared between two adjacent openings.

Figure 2A:
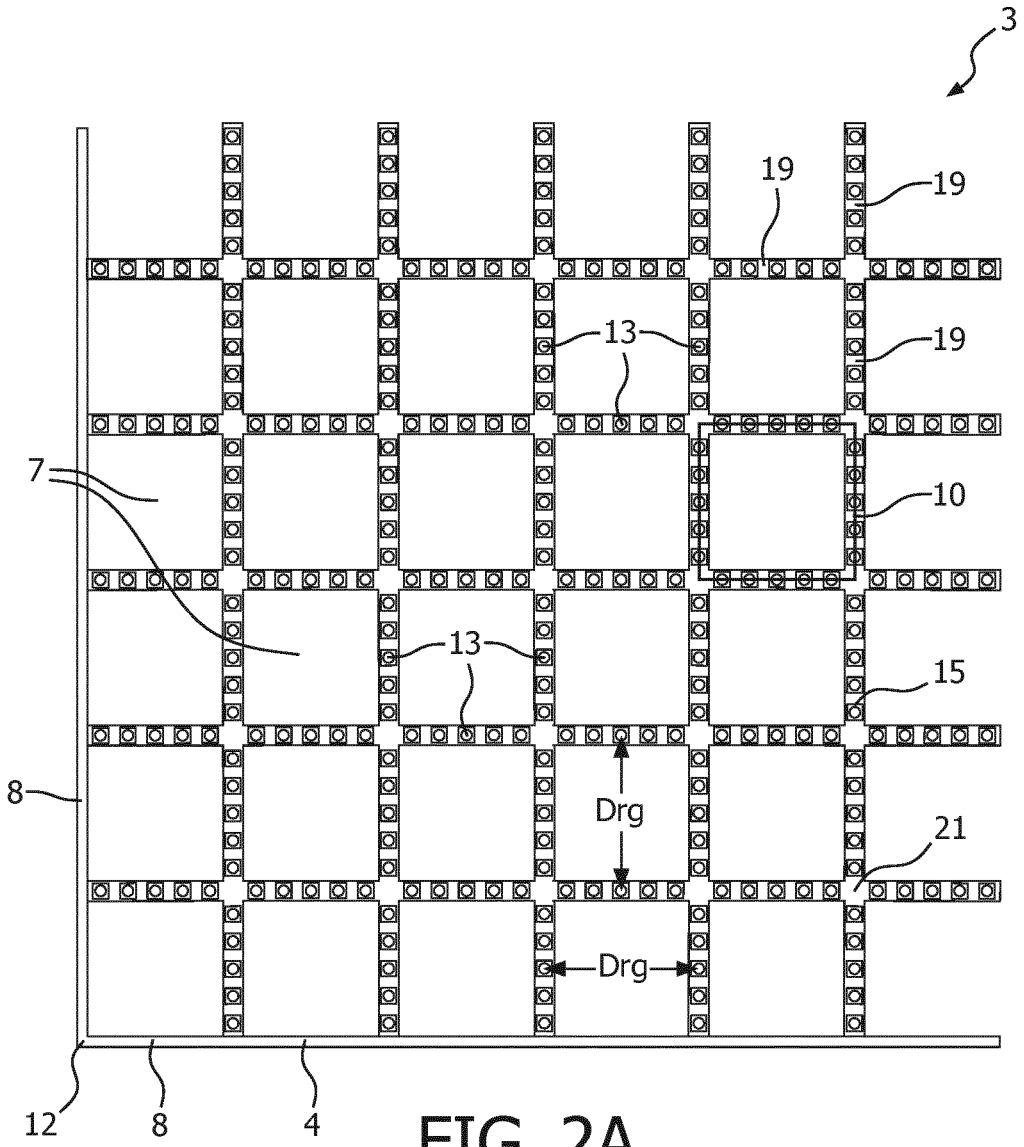
FIG. 2A-B shows a second embodiment of a grid sheet carrier according to the invention.
Figure 2B:
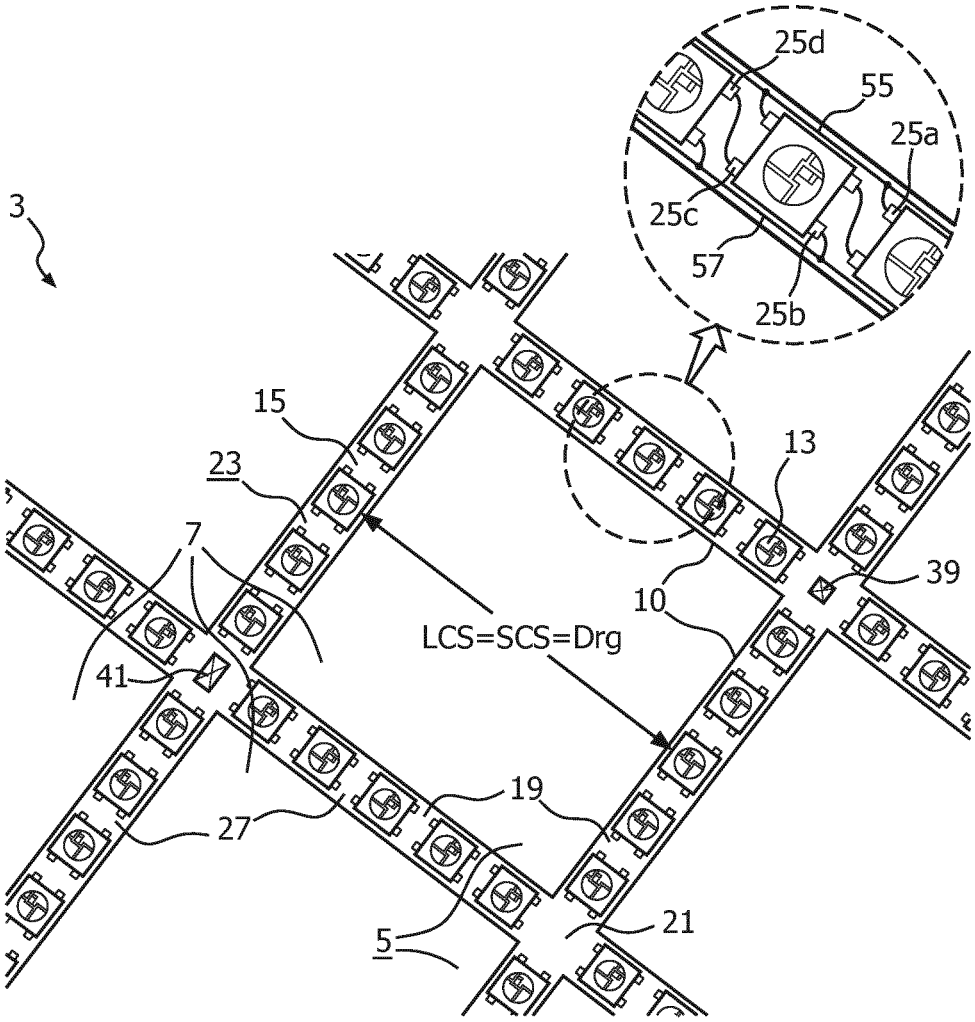

FIG. 2A shows a portion of a second embodiment of a grid sheet carrier 3 according to the invention to be mounted via a corner 12 formed by side edges 8 of its border 4 on a base part (not shown) with FIG. 2B showing a detail of said grid sheet. The grid sheet carrier comprises a plurality of square shaped openings 7 and a plurality of LEDs 13 mounted on one, i.e. the first, main face 15 of the grid sheet carrier. The LEDs are mounted as a row of five LEDs on each side of the perimeter 10 of each opening, i.e. only at bridges 19 between the openings and not at nodes 21. Hence, the number of associated LEDs per opening is twenty and the ratio R between the number of LEDs and openings is ten, as each row of five LEDs is shared between two adjacent openings. The shortest distance between LEDs of opposite sides is the same as the average distance Drg between LEDs on opposite sides around one opening.

In this embodiment the LEDs are individually addressable. Thereto, a grid like pc board 23 covered with LEDs is mounted on the grid sheet carrier, the LEDs are for example WS2812 LEDs for ease of control, these LEDs come in a 5050 package (5×5 mm) and have four terminals 25*a-d*, i.e. +5V terminal 25*a* connected to lead wire 55, terminal GND 25*b* connected to neutral wire 57, Data in 25*c* and Data out 25*d* forming with the LEDs part of the data cable. All LEDs are connected in parallel with respect to the power supply, while they are all connected in series data wise. So the grid can electronically be seen as a single led bridge. Furthermore, as shown in FIG. 2A-B, the grid sheet carrier is a regular grid with all the openings having the same size and shape, i.e. squares, and with all the bridges have the same width. The open surface area 5 and the surface area 27 formed by the carrier material have a surface ratio Sr of about three, i.e. well within the ratio of 1<=Sr<=10. As the openings are square, a ratio CSr between the largest LCS and smallest cross section SCS of each opening is one. In the embodiment shown in FIG. 2A-B, a distance sensor 39 is mounted at one node and a presence or occupancy detection sensor 41 is mounted at another node on the same main face as the LEDs of the grid sheet carrier.

Figure 3:
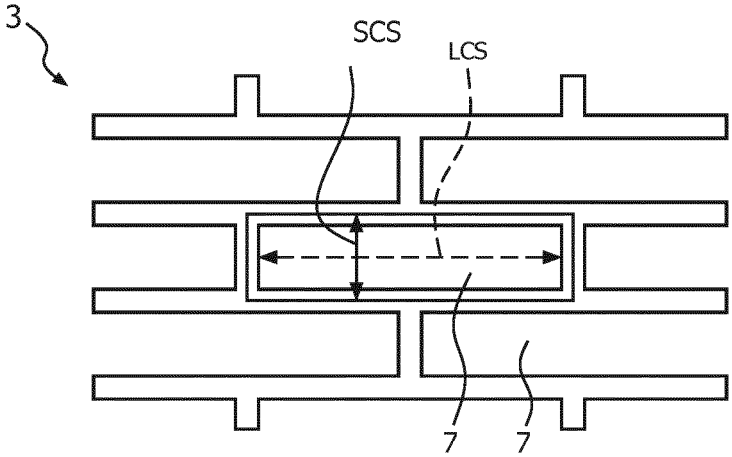
FIG. 3 shows a part of a third embodiment of a grid sheet carrier according to the invention.

FIG. 3 shows a part of a third embodiment of a grid sheet carrier 3 according to the invention in which the grid sheet carrier has a ratio CSr between the largest LCS and smallest cross section SCS of each opening 7 of about four, i.e. well within the ratio of 1<CSr<=6. Note that if the shape of the openings is very elongated, i.e. has large difference in opposite LED distances, as is the case in FIG. 3, the most prevalent distance, or the average distance between opposite LEDs preferably should be used as a base for the estimation of Drg, see also FIG. 2B and FIG. 4-A-C. In the case of the FIG. 3 this is SCS, since more opposite LED pairs are at this shorter distance.

Figure 4A:
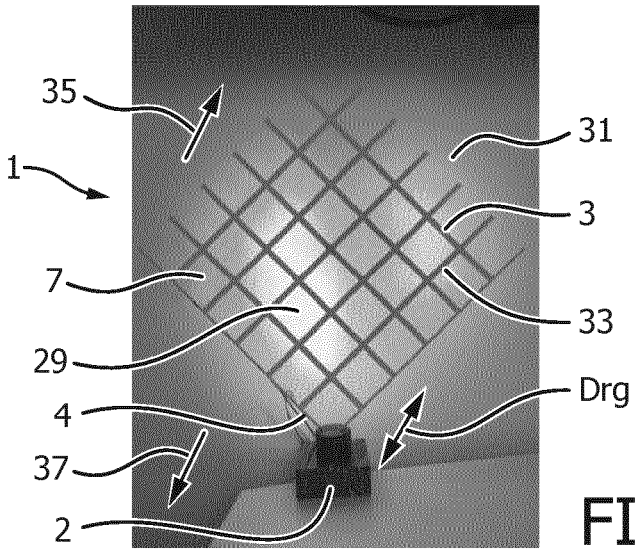
FIG. 4A-C shows three illustrative examples of (dynamic) light patterns obtained by the lighting device according to the invention in an installed position.
Figure 4B:
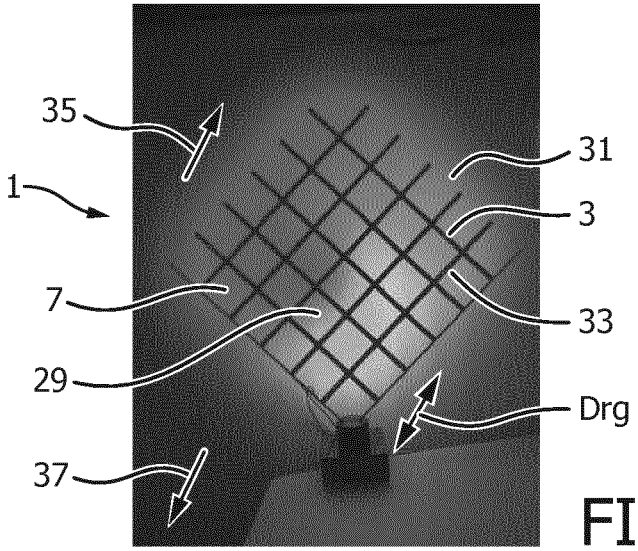
Figure 4C:
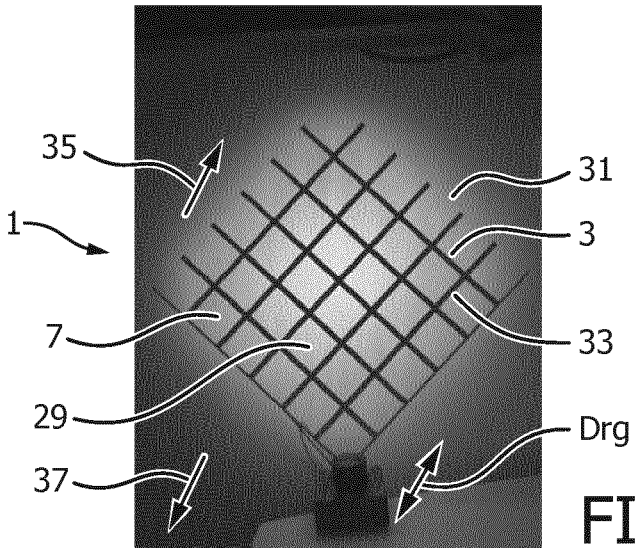

FIG. 4A-C shows three illustrative examples of (dynamic) light patterns 29 obtained by the lighting device 1 according to the invention in an installed, operating state. The lighting device has regular grid 3 mounted with a part of its border 4 on a base part 2 and on which grid the LEDs (not shown/visible) are mounted and which is facing with a first main face (not shown) towards a reflective body 31, in the figure a reflective wall, which is at a distance of about Drg, with Drg being the average shortest distance between LEDs on opposite sides around one opening (see FIG. 2B). The regular grid faces with a second main face 33 towards the users, said second main face is opposite to the first main face on the grid sheet carrier. The LEDs are hidden by the regular grid from (direct) view by users. Light source light from the LEDs is issued in a first direction 35 towards the reflective body, reflected back as reflected light source light by said reflective body in a second direction 37, essentially opposite to the first direction, through the openings 7 in the regular grid. As can be appreciated from the FIGS. 4A-C, the lighting device renders a pleasant, more or less, 3D lighting effect with high resolution and with variation in color.

Figure 5A:
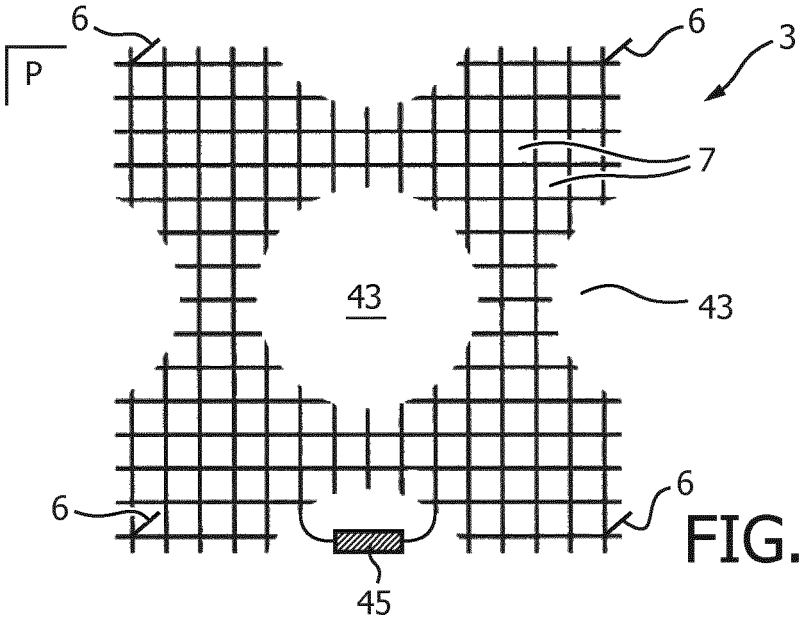
FIG. 5A-C shows several examples of various first patterns of grid sheet carriers.
Figure 5B:
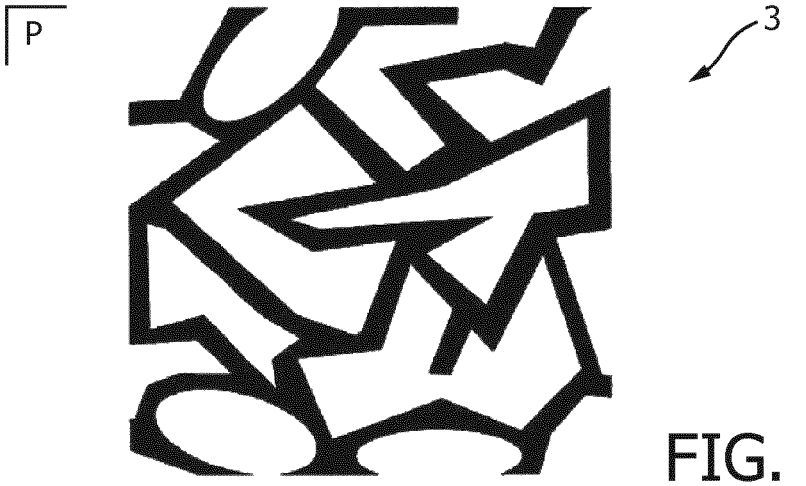
Figure 5C:
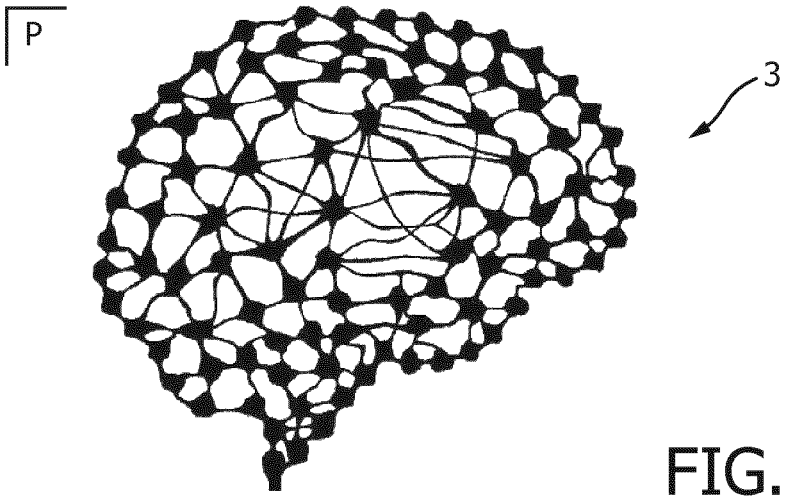

FIG. 5A-C shows several examples of various first patterns of grid sheet carriers. FIG. 5A shows a regular grid sheet carrier 3 which is provided with square shaped openings 7 but which additionally comprises relatively large, circle shaped further openings 43 or parts thereof. In these further openings, optionally further LEDs 45 may be provided, shown for one opening, said further LEDs may be independently operated from the LEDs and can, but not need to be mounted on the grid sheet carrier. In FIG. 5A the grid sheet the grid sheet comprises four support poles 6 mounted on the same main face as the LEDs and extend essentially transverse to the plane P of the grid. Via said at least one support pole the grid sheet can be mounted on a reflective body (not shown), for example a vertical wall, façade, ceiling or stand-alone reflector. As shown, the support poles in general have a length about equal to the average cross-sectional size of the openings. FIGS. 5B-C show examples of the grid sheet carriers 3 which are considered irregular grids. The irregular grid shown in FIG. 5B may have been inspired on the drawings/paintings of Keith Haring. The irregular grid 3 shown in FIG. 5C is inspired by neurons and their dendrites or axons of brains, the outer contour represents the human brain. Typically, in the designs shown in FIGS. 5A-C, the overall shape of the entire grid structure may also feature less dense areas or open areas, where the reflective body will not be entirely illuminated. It may be appreciated that irregular (or regular) grid designs which are shaped as company logo's are easily envisioned. It may be further appreciated that these designs can be (slightly) bend out of plane P, thus to assume a three-dimensional shape.

Figure 6A:
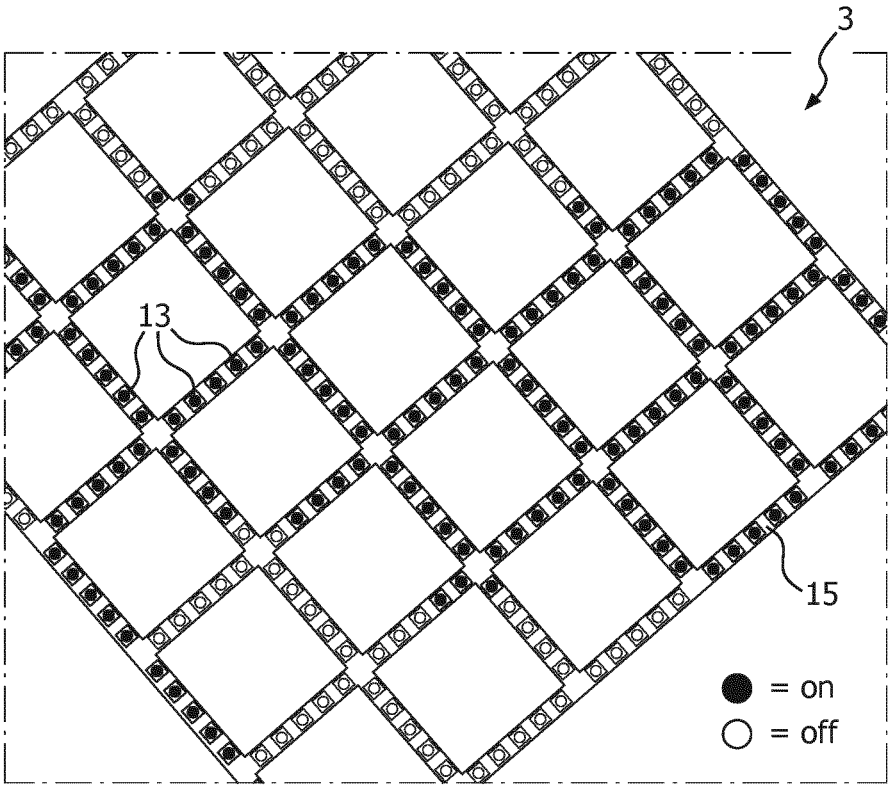
FIG. 6A-C shows various components of a fourth embodiment of a lighting device according to the invention.
Figure 6B:
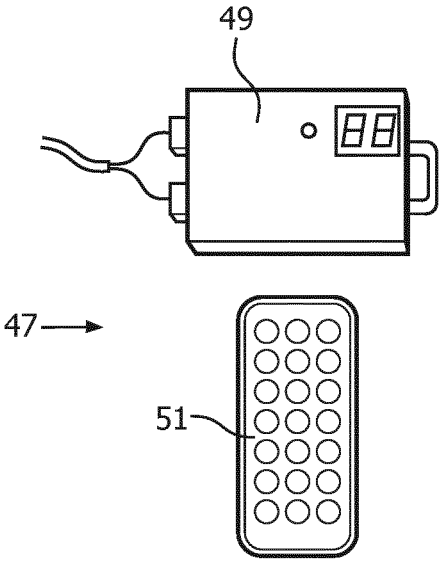
Figure 6C:
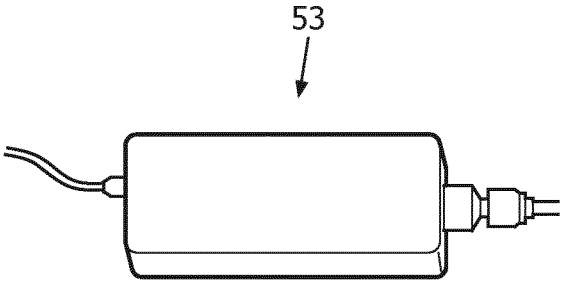

FIG. 6A-C shows various components of a fourth embodiment of a lighting device according to the invention. FIG. 6A show a first main face 15 of a regular grid sheet carrier 3 on which LEDs 13 are mounted. The LEDs are individually addressable as may be appreciated from their variation in brightness (and color). FIG. 6B shows a controller 47, comprising a microprocessor 49 and a separate remote user interface 51. The microprocessor is able to read content from a (removable) memory, and converts this into the appropriate control signals to control each LED on the grid. Content selection is done via a button or the simple remote. FIG. 6C shows a power supply 53 which provides power to the LEDs and the controller.

The invention claimed is:

1. A lighting device comprising:

a grid sheet carrier bordered by a border and comprising an open surface area of a plurality of openings and comprising carrier material surrounding said openings, said carrier material being arranged in a two-dimensional, first pattern, and wherein the grid sheet carrier is mounted via its border on a base part, a plurality of LEDs having an emission profile with a relatively large apex angle of at least 60 degrees and being mounted only on one main face of the carrier material and arranged in a two-dimensional, second pattern, wherein the second pattern is coinciding with the first pattern when superimposed, wherein the second pattern is at least a sub-pattern of the first pattern, and wherein R is a ratio between the plurality of LEDs and the plurality of openings, with R being at least three, wherein each opening has a perimeter of bridges and nodes formed by the carrier material, wherein the bridges are mutually connected at nodes, and wherein the LEDs are mounted on at least the bridges, wherein the LEDs are individually addressable or addressable in groups via a data cable provided at the bridges and nodes and the data cable is connected to a controller, and further comprising an at least partly diffuse reflector provided at an average distance Drg in a first direction from the grid sheet carrier, Drg being in the range of 0.5 to 2 times an average shortest distance d between two opposite LEDs around an opening, or Drg is essentially equal to said average shortest distance d.

2. The Lighting device as claimed in claim 1, wherein each opening is associated with at least four LEDs, or with at least eight LEDs.

3. The Lighting device as claimed in claim 1, wherein the plurality of LEDs are evenly distributed around the perimeter of a respective opening.

4. The Lighting device as claimed in claim 3, wherein the LEDs are mounted at the bridges and nodes.

5. The Lighting device as claimed in claim 4, wherein the LEDs are connected in parallel to a power supply and are connected in series to the data cable.

6. The Lighting device as claimed in claim 1, wherein the open surface area and the surface formed by the carrier material have a surface ratio Sr, with 1<=Sr<=10.

7. The Lighting device as claimed in claim 1, wherein over essentially the whole first pattern bridges of the surface formed by the carrier materials have an equal and constant width.

8. The Lighting device as claimed in claim 1, wherein a ratio CSr between a largest cross section LCS and a smallest cross section SCS of each opening is the range of 1<CSr<=6.

9. The Lighting device as claimed in claim 1, wherein the first pattern is a regular grid.

10. The Lighting device as claimed in claim 1, wherein the first pattern is an irregular grid.

11. The Lighting device as claimed in claim 1, wherein the grid sheet carrier is provided with at least one sensor mounted on the same face as the LEDs.

12. The Lighting device as claimed in claim 1, wherein the LEDs comprise RGB LEDs, RGBW LEDs, or RGBWA LEDs.

13. The Lighting device as claimed in claim 1, wherein the first pattern is made in one integral part.

14. The Lighting device as claimed in claim 1, wherein the grid sheet carrier is self-supporting.

* * * * *